United States Patent [19]

Sando et al.

[11] 4,184,346

[45] Jan. 22, 1980

[54] SEAL DEVICE FOR HIGH PRESSURE STEAMER

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 919,718

[22] Filed: Jun. 27, 1978

[30] Foreign Application Priority Data

| | | | |
|---|---|---|---|
| Jul. 4, 1977 | [JP] | Japan | 52-79684 |
| Jul. 21, 1977 | [JP] | Japan | 52-87541 |
| Dec. 19, 1977 | [JP] | Japan | 52-152533 |

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 3,137,151 | 6/1964 | Yoshiike | 68/5 E |
| 3,299,676 | 1/1967 | Fujihashi | 68/5 E |
| 4,017,258 | 4/1977 | Sando et al. | 68/5 E X |
| 4,064,713 | 12/1977 | Sando et al. | 68/5 E |

FOREIGN PATENT DOCUMENTS

| | | | |
|---|---|---|---|
| 697673 | 11/1964 | Canada | 34/242 |
| 333985 | 5/1972 | U.S.S.R. | 68/5 E |

*Primary Examiner*—Philip R. Coe

*Attorney, Agent, or Firm*—Toren, McGeady and Stanger

[57] ABSTRACT

A seal device having a pair of rubber seal rolls arranged in pressed contact with each other at a cloth material passing port of a drum body of a high pressure steamer adapted for hygro-thermic treatment of textile products such as a cloth material. Seal plates which are formed with a flexible and elastic metal or synthetic resin sheet and upper or lower sides of which are secured to edge portions of the cloth material passing port disposed in parallel with the pair of seal rubber rolls while the other sides are in pressed contact with the seal rubber rolls. An air chamber formed in a triangular cross-sectional shape connects a pressed contact point between the rubber seal rolls respectively to contact points between the seal plates and the seal rubber rolls, and air pressure is supplied to the air chamber through an air supply passage. A pair of correcting air jet pipes are spaced across the cloth material and arranged to blow air to both sides of the cloth material to correct its posture for preventing it from being wound on the surface of the seal rubber rolls after it has passed these rolls. A passage is provided for expelling to the outside a surplus portion of the air supplied to the air chamber to prevent it from coming into the drum body.

1 Claim, 5 Drawing Figures

SEAL DEVICE FOR HIGH PRESSURE STEAMER

BACKGROUND OF THE INVENTION

1. Field of the Invention

This invention relatesto a seal device for pressure sealing the textile product inlet and outlet of a high pressure steamer adapted for the high pressure hygrothermic treatment of textile products.

2. Description of the Prior Art

High pressure steamers which apply a saturated steam of high temperature and high pressure to textile products for high temperature and high pressure treatment have been known. Further, as for seal devices for introducing the textile products into the steamer and guiding them to the outside of the steamer, the inventors of the present invention have conducted studies over a long period of time and have filed many applications for patents for such sealing devices. In the latest one of the seal devices which have been developed by the inventors, there are provided a pair of rubber seal rolls; and seal plates which shut the inside of a steamer from the outside thereof at a position as close as possible to the pressed contact point between the pair of rubber seal rolls.

SUMMARY OF THE INVENTION

It is an object of this invention to provide a seal device which is an improvement on the above mentioned previous seal device of a high pressure steamer and which is of a simpler construction and yet is more effective than the previous seal device.

In accordance with this invention, air pressure higher than the internal pressure of a high pressure steamer is applied to the internal pressure receiving faces of a pair of rubber seal rolls which are disposed in pressed contact with each other at an opening of a penetrating hole provided at the textile product inlet or outlet and which are thus arranged to close the opening. The action of steam heat on the rubber seal rolls is thus shut out by the air pressure with a simple construction and yet an effective sealing is ensured.

The above and further objects and advantages of this invention will be apparent from the following detailed description of preferred embodiments taken in conjunction with the accompanying drawings.

BRIEF DESCRIPTION OF THE DRAWINGS

All of the accompanying drawings illustrate the invented seal device for a high pressure steamer.

DETAILED DESCRIPTION OF PREFERRED EMBODIMENTS

Embodiment EXAMPLE I

Figure 1:
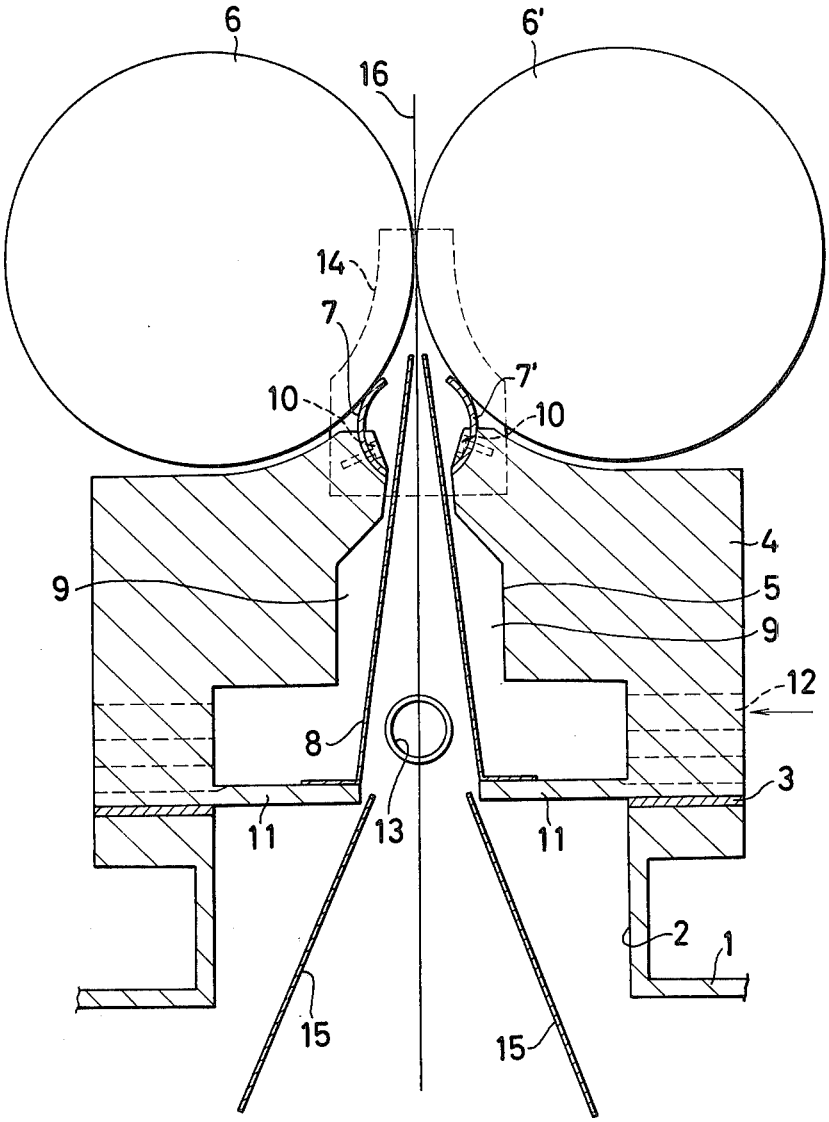
FIG. 1 is a cross-sectional view showing a first embodiment of the seal device of the invention.

Referring to FIG. 1, reference numeral 1 indicates a drum body of a high pressure steamer. A seal block 4 is mounted on a seal packing 3 on a cloth material inlet 2 into the high pressure steamer drum body 1. A penetrating hole 5 is provided through the seal block 4. A pair of rubber seal rolls 6 and 6' are freely rotatably disposed on the upper side of the seal block 4. The pair of rubber rolls 6 and 6' are arranged in pressed contact with each other to close an upper opening of the penetrating hole 5. Further, the lower sides of a pair of curved elastic seal plates 7 and 7' are secured through retainers 10 to the edge part, i.e. a pressure receiving face, of the upper opening of the penetrating hole 5 provided in the seal block 4 while the upper sides of the seal plates 7 and 7' are elastically pressed against the rubber seal rolls 6 and 6'. In this embodiment, the seal plates 7 and 7' are made of stainless steel, though the present invention is not limited to the use of any specific materials for the seal plates. A cylindrical duct 8 is disposed inside of the penetrating hole 5. The inside of the cylindrical duct 8 is arranged to allow a cloth material to pass therethrough. Between the inner face of the penetrating hole 5 and the outer circumferential face of the cylindrical duct, there is formed an air passage 9 for passing a pressure gas therethrough. The upper opening part of the cylindrical duct 8 extends close to pressure contact area between the seal rubber rolls. The lower opening part of the cylindrical duct 8 is secured to a flange portion 11 on the inner wall of the cloth material inlet 2. Air pressure higher than the internal pressure of the steamer drum body is allowed to come into the air passage 9 through an air pressure supply port 12. A pressure reduction exhaust port 13 is provided in the lower part of the cylindrical duct 8. An end seal plate 14 is arranged in pressed contact with the end faces of rubber seal rolls 6 and 6' and those of the seal plates 7 and 7'. Numeral 15 indicates drain preventing plates and 16 a cloth material to be treated. The above description covers the arrangement for the cloth material inlet. A cloth material outlet is arranged in the same manner as the cloth material inlet.

The embodiment of the above described structural arrangement operates in the following manner:

The cloth material is introduced into the steamer drum body 1 through the pressed contact area between the rubber seal rolls and the cylinder duct 8. Then, air pressure higher than the internal pressure of the steamer drum body is supplied to the air pressure passage 9. The air pressure repulses the internal steam pressure of the steamer drum body and acts on the pressure receiving faces of the rubber seal rolls to prevent the steam in the steamer drum body from acting on these pressure receiving faces and thus to protect the rubber seal rolls from being heated by the steam heat. A gas mixture gas consisting of the air of the air pressure and the steam in the vicinity of the pressure receiving faces of the rubber seal rolls is gradually expelled through the pressure reduction exhaust port 13 to always have fresh air applied to the pressure receiving faces of the seal rubber rolls.

As described in the foregoing, in this embodiment, air pressure supplied from the outside acts on the faces of rubber seal rolls which are receiving the internal steam pressure of the drum body. The air pressure thus prevents the steam heat from readily acting on the pressure receiving faces of the rubber seal rolls and thus to effectively protect the rubber seal rolls from being heated and having thermal expansion so that a durable seal device can be obtained.

Embodiment EXAMPLE II

Figure 2:
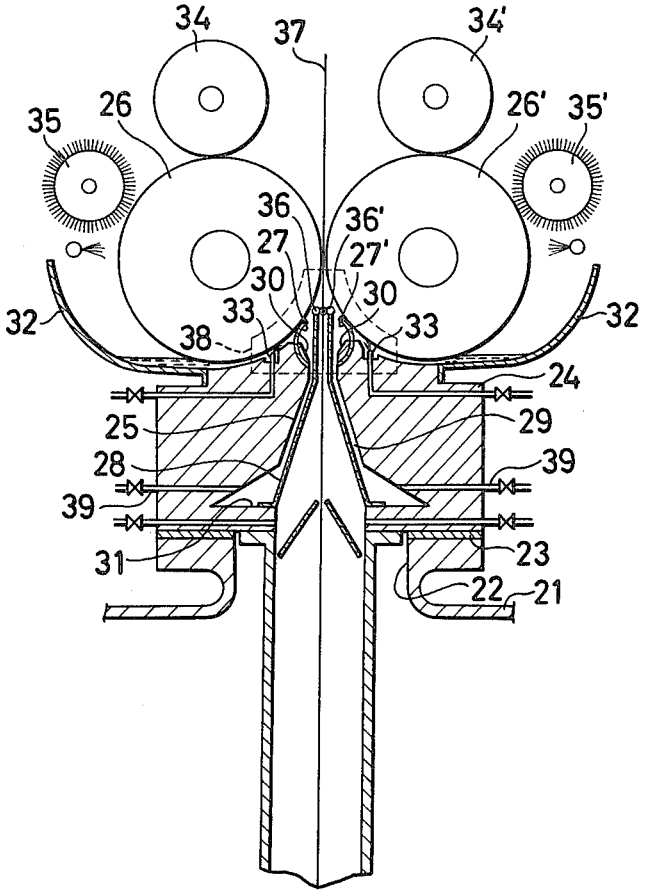
FIG. 2 is a cross-sectional views showing a second embodiment.
Figure 3:
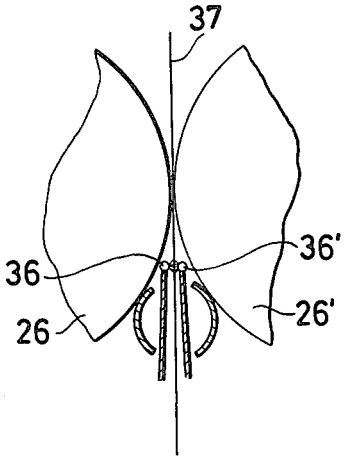
FIGS. 3 and 4 are sectional enlarged view showing an essential part of the second embodiment.
Figure 4:
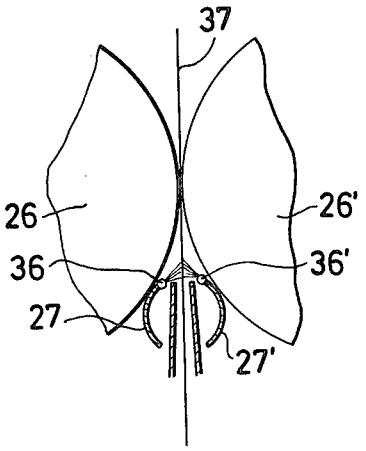

In FIGS. 2 through 4, reference numeral 21 indicates a high pressure steamer drum body adapted to treat a cloth material under high humid heat. A seal block 24 is securely mounted on a cloth material inlet 22 of the high pressure steamer drum body 21 with a seal packing 23 therebetween. Inside the seal block 24, there is provided a penetrating hole 25 which communicates with the inside of the steamer drum body 21. A pair of rubber seal rolls 26 and 26′ are freely rotatably supported by the upper side of the seal block 24. The upper opening of the above mentioned penetrating hole 25 is closed by the pair of rubber seal rolls 26 and 26′ and by an end face seal plate 38 which is in contact with the end faces of the rubber seal rolls 26 and 26′. Further, the lower ends of a pair of arc-shaped elastic seal plates 27 and 27′ are secured to the upper opening edge portion of the penetrating hole 25 of the seal block 24 through retainers 30. The upper outside faces of these seal plates 27 and 27′ are elastically pressed into contact with the rubber seal rolls 26 and 26′. No particular restriction is imposed on the material of the seal plates 27 and 27′. However, in this embodiment, they are made of stainless steel. A cylindrical duct 28 which is formed to have a narrowed upper end portion is disposed inside the penetrating hole 25. The inside of the cylindrical duct 28 is arranged to allow a cloth material to pass therethrough. A gas passage 29 which allows a pressure gas to pass therethrough is formed between the outer circumferential face of the cylindrical duct 28 and the inner face of the penetrating hole 25. Further, the upper end opening portion of the cylindrical duct 28 extends to the vicinity of the pressed contact area between the pair of the rubber seal rolls. The lower end opening portion of the cylindrical duct 28 is secured to the flange portion of the seal block 24.

A cooling water-washing tank 32 is arranged so that the lower part of the seal rubber rolls 26 and 26′ is immersed in it. Washing water jet nozzles 33 provide washing water to the pressed contact area between the seal rubber rolls 26 and 26′ and the seal plates 27 and 27′ from an area between the seal rubber rolls 26 and 26′. Wiping rolls 34 and 34′ are in pressed contact with the upper parts of the seal rubber rolls 26 and 26′ while washing brush rolls 35 and 35′ are in pressed contact with the side parts of the seal rubber rolls 26 and 26′. Correction air jet pipes 36 snd 36′ are mounted on the edge of the upper end opening of the cylindrical duct 28. The air jetted from this pair of correction jet pipes 36 and 36′ serves to correct a cloth material 37 being introduced into the cylindrical duct 28 through the seal rubber rolls 26 and 26′ so that it has in a vertical posture and thus prevents the cloth material 37 from tending to be wound on the seal rubber rolls. Air pressure supply ports 39 provide air pressure to the gas passage 29.

FIGS. 2 and 3 show an example of embodiment wherein the correction air jet pipes 36 and 36′ are mounted on the edge of the upper end opening of the cylindrical duct 28. However, this invention is not limited to such arrangement but the correction air jet pipes 36 and 36′ may be mounted, for example, on the upper end edge of the elastic seal plates 27 and 27′ to jet air to the cloth material 37 as shown in FIG. 4.

In the present embodiment, as described in the foregoing, a pair of correction air jet pipes 36 and 36′ are arranged, with spacing between them, on the upper end edge of the cylindrical duct 28 or at each of the elastic seal plates 27 and 27′ in positions as close as possible to the pressed contact area between the seal rubber rolls and to their pressure receiving faces which receives the internal pressure of the steamer body. These pipes extend in parallel with the axes of the seal rubber rolls and are provided with nozzles arranged in the longitudinal direction thereof. The cloth material is guided between the two correction air jet pipes while jet air is applied to both sides of the cloth material to correct the travelling direction of the cloth material and to prevent the cloth material from being wound on the seal rubber rolls.

Embodiment EXAMPLE III

Figure 5:
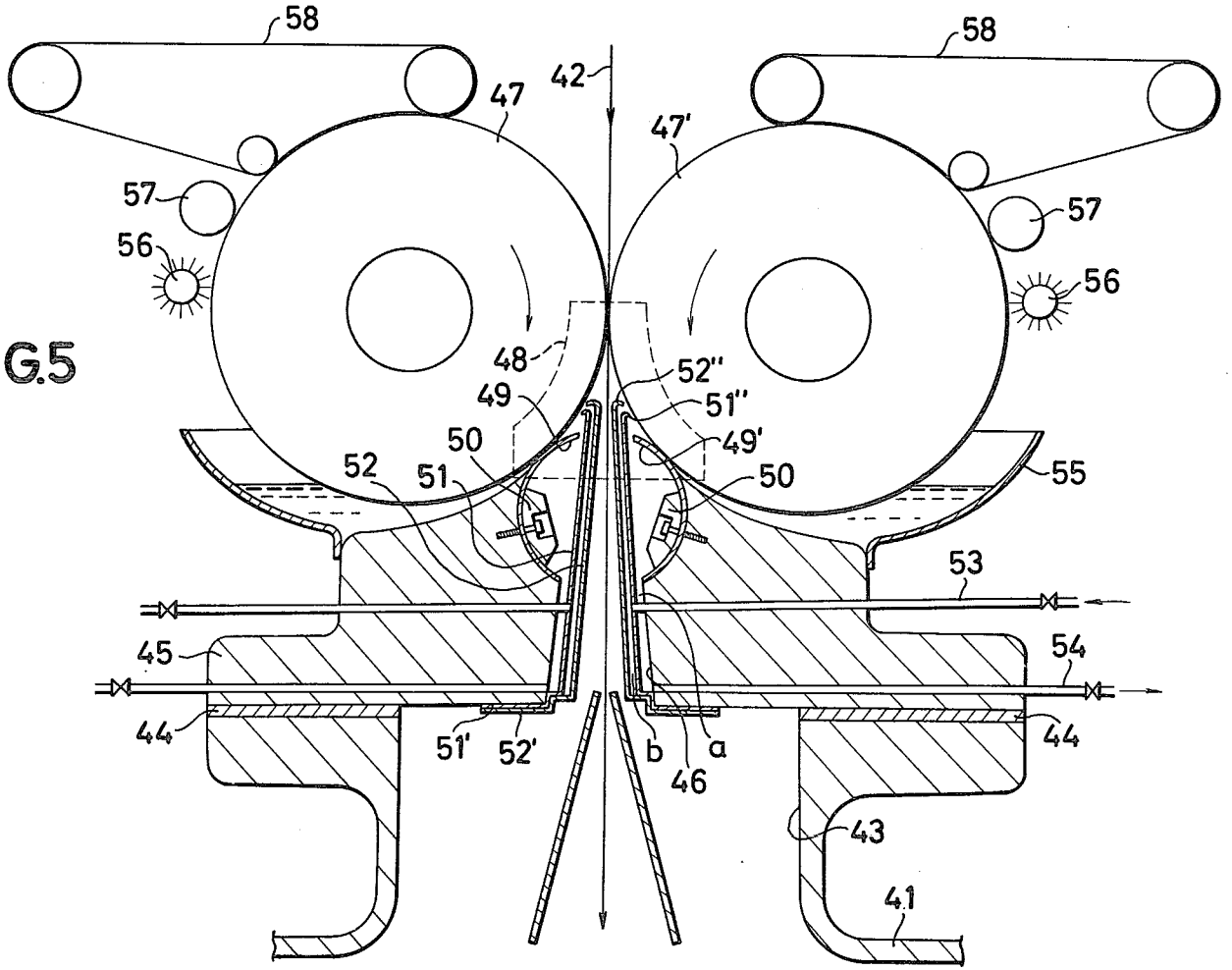
FIG. 5 is a cross-sectional view showing a third embodiment of the invention.

In FIG. 5, a reference numeral 41 indicates a high pressure steamer drum body adapted to treat a cloth material 42. A seal block 45 is secured to a cloth material inlet 43 of the drum body 41 with a seal packing 44 between them. Inside the seal block 45, there is provided a penetrating hole 46 which communicates with the inside of the steamer drum body 41. A pair of rubber seal rolls 47 and 47′ are freely disposed on the upper side of the seal block 45 and are arranged in pressed contact with each other. An upper end opening of the penetrating hole 46 is closed by the pair of rubber seal rolls 47 and 47′ and also by an end face seal plate 48 which is in contact with one end face of each seal rubber roll. The lower end edges of a pair of elastic seal plates 49 and 49′ each of which is curved into an arc like shape are secured by retainers 50 to the upper opening edge portions of the penetrating hole 46 of the seal block 45. The upper end outer face portions of the seal plates 49 and 49′ are pressed elastically into contact with the seal rubber rolls 47 and 47′. In this embodiment, the seal plates 49 and 49′ are formed of stainless steel plates, though the material for the seal plates is not particularly limited to stainless steel. An outer cylindrical duct 51 is disposed inside the penetrating hole 46 and is formed with a narrow upper end portion leaving gap passage (a) between it and the inner circumferential face of the penetrating hole 46. Within the outer cylindrical duct 51, there is provided an inner cylindrical duct 52 which leaves a gap passage (b) between it and the inner circumferential face of the outer cylindrical duct 51. Flanges 51′ and 52′ are formed respectively at the lower end of the outer and inner cylindrical ducts 51 and 52 and are secured to the edge of the opening in the lower side of the seal block 45. The upper open end of the inner cylindrical duct 52 are positioned to be as close as possible to the pressed contact area between the rubber seal rolls 47 and 47′. Further, the upper open end of the outer cylindrical duct 51 is positioned a little lower than the position of the upper open end of the inner cylindrical duct 52. At the upper open ends of the outer and inner cylindrical ducts 51 and 52, there are formed hooked portions 51″ and 52″ which are directed toward the space between the seal rubber rolls and the elastic seal plates. A fluid supply pipe 53 is arranged to communicate with the gap passage (b) while a fluid discharge pipe 54 is arranged to communicate with the gap space (a).

Although the following parts are not essential to this invention, a cooling water-washing tank 55 is arranged with the seal rubber rolls 47 and 47′ immersed therein; water removing rolls 57 are arranged to be in contact with the seal rubber rolls; and wiping endless cloth belts 58 are provided for wiping the seal rubber rolls 47 and 47′.

The structural arrangement being as above mentioned, this embodiment operates in the following manner: The pair of seal rubber rolls are rotated in the directions of arrows respectively. At the same time, fluid pressure such as pressure air or pressure water is supplied from the fluid supply pipe to the gap passage (b). When, for example, pressure air not exceeding 100° C. is supplied as fluid pressure to the gap passage (b), the pressure air spouts out of the upper ends of both cylindrical ducts 51 and 52 and jets toward spaces between the seal rubber rolls and the seal plates. The pressure air supplied between the seal rubber rolls and the seal plates is taken in as the seal rubber rolls rotate to give a lubricating effect. Surplus pressure air between the seal rubber rolls and the seal plates is discharged by the exhaust pipe 54 through the gap passage (a). The same seal effect can be obtained with pressure water employed in place of the pressure air.

As described in the foregoing, in accordance with the present invention, fluid pressure such as water or a gas is arranged to spout in to the pressed contact area between the rubber seal rolls and the seal plates in the rotating direction of the seal rubber rolls. Thus, the pressure fluid is gradually taken in between the seal rubber rolls and the seal plates. The pressure fluid taken in between the seal rubber rolls and the seal plates has a lubricating effect on the rotation of the rubber seal rolls to enhance the wear resistance of the rubber seal rolls. Water or pressure air not exceeding 100° C. is thus employed as a lubricant for the purposes of: Obtaining the above states lubricating effect; protecting the cloth material from being soiled; and economization of heat energy. When water is used for this purpose, moisture is imparted to the seal rubber rolls and the seal plates for a lubricating effect. When pressure air not exceeding 100° C. is used, the temperature of the pressure air is lower than the temperature of gas (102° C. or above) of the inside of the steamer body. Therefore, collision between the pressure air of less than 100° C. and the gas within the drum body of 102° C. or above produces highly humid air which sticks to the seal rubber rolls and the seal plates to give a lubricating effect.

The surplus portion of the pressure fluid other than the portion taken in between the seal rubber rolls and the seal plates is discharged to the outside through the gap passage (a). Therefore, the pressure fluid such as water or steam never comes to stick to the cloth material 42, so that uneven treatment of the cloth material can be prevented.

What is claimed is:

1. A seal device for a high pressure steamer including a steamer drum body having an opening into the interior thereof, a seal block mounted on said steamer drum body at the opening with the seal block forming a hole communicating with the opening and providing a port forming a passageway for moving a cloth material between the exterior and the interior of said steam drum body, said steamer being arranged for hydro-thermic treatment of textile products, a pair of rubber seal rolls mounted on said seal block exteriorly of said steamer drum body and disposed in pressed contact with one another forming a seal across the port through said seal block, flexible elastic seal plates located within said port and attached to said seal block, said seal plates extending in parallel relation with the axis of said seal rolls and the inner surfaces of each of said seal plates facing toward the other on the opposite side of the passageway formed through said port for the cloth material so that the cloth material passes between the inner surfaces of said seal plates, the outer surfaces of each said seal plate disposed in contact with a different one of said seal rolls inwardly of the location of pressed contact of said seal rolls, wall means secured within said port through said seal block and forming a duct for the passage of the cloth material, said duct having a first end located inwardly of and closely adjacent to said seal rolls and a second end adjacent the opening into said steamer drum body, said duct spaced inwardly from the surface of said port through said seal block and also inwardly of said seal plates forming an air chamber space between said seal block and said duct which space is closed adjacent to the opening to said steamer drum body and is open between said seal plate and said duct adjacent the location of pressed contact of said seal rolls, means for supplying air into said air chamber space at a location spaced from said seal rolls and at a pressure higher than the internal pressure within said steam drum body so that the pressurized air is directed between the location of pressed contact of said seal rolls and the contacting locations of said seal plates and said seal rolls, wherein the improvement comprises a pair of correction air jet pipes each located on the end of said duct adjacent the pressed contact location of said seal rolls and each disposed on an opposite side of the opening into said duct so that each said jet pipe blows air towards a different surface of the cloth material passing between the seal rolls and the adjacent end of said duct for correcting the position of the cloth and for preventing the cloth from being wound onto the surface of said seal rolls.

* * * * *